United States Patent [19]

Suzuki

[11] 4,083,287

[45] Apr. 11, 1978

[54] WIND INSTRUMENT

[76] Inventor: Yoshiro Suzuki, 7-15, Shirakawa 1-Chrome, Koto-ku, Tokyo, Japan

[21] Appl. No.: 681,126

[22] Filed: Apr. 28, 1976

[30] Foreign Application Priority Data

May 1, 1975 Japan ..... 50-52012

[51] Int. Cl.[2] ..... G10D 7/12

[52] U.S. Cl. ..... 84/377; 84/330

[58] Field of Search ..... 84/330, 93, 386, 351, 84/377, 350, 83

[56] References Cited

U.S. PATENT DOCUMENTS

| | | | |
|---|---|---|---|
| 1,698,958 | 1/1929 | Miessner | 84/377 |
| 2,167,582 | 7/1939 | McCord | 84/330 |
| 2,197,773 | 4/1940 | Rosenfield | 84/330 |
| 2,461,806 | 2/1949 | Borel | 84/377 |
| 3,339,443 | 9/1967 | Heath | 84/377 |
| 3,986,427 | 10/1976 | Swain | 84/377 |

*Primary Examiner*—Stephen J. Tomsky
*Attorney, Agent, or Firm*—Polster, Polster and Lucchesi

[57] ABSTRACT

A wind instrument having a tone color produced from sound producing reeds in response to the blowing of breath through a mouthpiece, is played by manipulating keys arranged to produce notes of the scale in the same manner as a conventional classical wind instrument such as a clarinet, saxophone, trumpet or french horn, as the case may be. The instrument is constructed with a main body of the wind instrument, a plurality of scale operations keys, air passageway change-over valves, a plurality of groups of sound producing members which produce tones in correspondence to finger action of the scale operation keys, and a mechanism for forming the air passageway to introduce air blown in from a mouthpiece of the wind instrument by the operations of a corresponding air passageway change-over valve into the corresponding sound producing member.

3 Claims, 28 Drawing Figures

WIND INSTRUMENT

BACKGROUND OF THE INVENTION

This invention relates to a new type of wind musical instrument that has the form of a conventional brass or woodwind instrument and which can be played by using the conventional fingering pattern of the wind instrument such as, for example, saxophone, trumpet, and so forth. More particularly, the invention is concerned with such wind instrument which, although it produces a tone other than that which would ordinarily be produced by the wind instrument it is designed to simulate, nevertheless produces the appropriate notes of the scale by exactly the same finger action to play it, while blowing breath thereinto through a mouthpiece.

Various kinds of musical instruments such as wind instruments, percussion instruments, stringed instruments, and so forth have been used since olden times. These various musical instruments are all unique in their configurations, method of playing, and musical tones, hence they are not able to produce a tone other than that said to be the characteristic of the musical instrument concerned.

However, there have emerged the so-called electric and electronic musical instruments such as the electronic organ, sometimes called an 'electone', etc. which have superceded the orthodox ideas with respect to such conventional musical instruments. By the emergence of this new type of electric and electronic musical instrument, it has become possible to produce various musical tones which resemble those of various musical instruments, or any other unique musical tones by electrically synthesizing sounds. However, as these electric and electronic musical instruments are generally played in the manner of a piano they cannot be played properly unless one can play the piano.

If various musical tones other than those peculiar to a particular wind instrument could be produced with the playing technique being the same as that of the wind instrument, it would contribute very much to expand possible areas of playing wind instruments, to further enrich the playing of such musical instruments, to increase the number of enthusiasts in music, and to diffuse and popularize such musical instruments per se. Conventionally formation of the musical scale in the wind instrument is governed only by the length of the tube constituting the wind instrument, so that only a given sound can be produced regardless of whether a single playing key or a plurality of playing keys are depressed at a time. In other words, in the wind instrument, the key and the sound producing member are not in a par relationship of 1 to 1 as in the key board of the piano; each of the keys is not provided with an independent sound producing member which corresponds to the individual key, on account of which the wind instruments have been constructed in such a way that no simple combination of playing keys has been capable of producing varieties of musical tones.

Applicant has already completed an electrically-operated wind instrument, wherein the abovementioned difficulty has been solved by the combination of a group of electric sound producing members, a group of change-over switches for selecting a predetermined one of a series of sound producing members, and scale operation keys of the wind instrument (vide: U.S. Pat. No. 3,897,708).

SUMMARY OF THE INVENTION

With the abovementioned various disadvantages in mind, it is an object of the present invention to provide a further improved wind instrument, wherein the method of playing of the instrument is made much closer to that of the conventional wind instrument by carrying out the key operation, while blowing breath air thereinto.

It is another object of the present invention to provide a musical wind instrument of a type which makes it possible to aquire skill in playing the wind instrument at even a minor age, and which is suitable as the musical instrument for educational purpose with the method of playing or performing technique remaining the same as that of the ordinary wind instruments.

It is still another object of the present invention to provide a wind instrument which can produce tones of sound which are more faithful to the tones of sound proper to the wind instrument by the use of an air vibration type sound producing members than by the use of the electrical sound producing members.

It is another object of the present invention to provide a musical wind instrument which is capable of being freely carried and played at any desired place such as hills and dales without need of electric power supply to operate the musical instrument.

It is still another object of the present invention to provide a musical wind instrument, wherein the compass of the scale can be freely and properly expanded to two octaves and more, depending on necessity, by changing combination of the musical scale of the sound producing member, and which can be constructed in a small size without being affected by the length and shape of the tube as well as in an arbitrary configuration which is not confined to the configuration of the conventional wind instrument.

According to the present invention, generally speaking, there is provided a wind instrument of a type comprising a main body of the wind instrument, a plurality of playing keys, air passageway change-over valves, a plurality of groups of sound producing members which produce tones in correspondence to fingering action of said playing keys, and means for forming said air passageway to introduce air blown therein from a mouthpiece by the operation of corresponding air passageway change-over valve into the corresponding sound producing member.

The foregoing object, other objects, and detailed construction as well as function and resulting effect of the wind instrument according to the present invention will become apparent and more clearly understandable from the following detailed description thereof when read in conjunction with the accompanying drawing.

BRIEF DESCRIPTION OF THE DRAWING

In the drawing:

FIG. 24 is a partial cross-sectional view taken along a line XXIV—XXIV in FIG. 21 showing a shifting mechanism of cylindrical barrel, on which

DETAILED DESCRIPTION OF PREFERRED EMBODIMENT

In a wind instrument, the pitch of sound is governed by the length of the tube. For changing the tube length, there are two types, that is, "side port control type" and "valve control type". The present invention is applicable to both types of the tube length control. It should, however, be understood that the present invention, as will be described hereinbelow, is not one that determines the pitch of the sound by the length of the tube.

In the following, explanations of the present invention will be made with respect to a saxophone as a representative example of the wind instrument of the side port control type having a large number of scale operation keys for playing the instrument, although the invention is applicable not only to the saxophone along, but also to other wind instrument of the same controlling type such as clarinet, and so forth.

Figure 1:
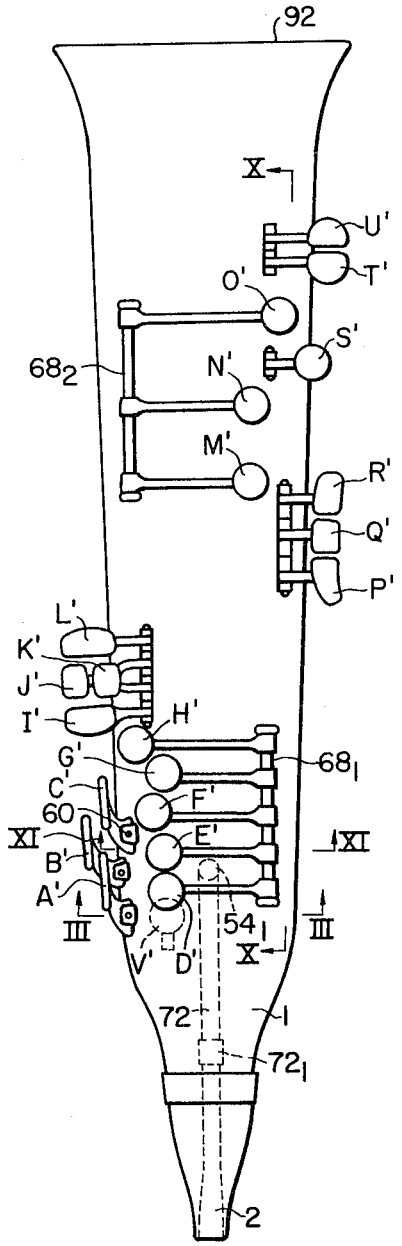
FIG. 1 is a schematic diagram showing an outer appearance of a saxophone.

Referring now to FIG. 1, there is illustrated a general, external appearance of the saxophone. The tubular body is not limited to the conventional shape, as has already been mentioned in the preceding. In the drawing, a reference numeral 1 designates a cylindrical barrel constituting the saxophone main body, at one end of which there is provided a mouthpiece, and, on the outer peripheral portions of which there are provided a plurality of scale operation or playing keys A' to U' same in number and arrangement as those in the conventional saxophone. Incidentally, a reference letter V' is an octave key.

Figure 2:
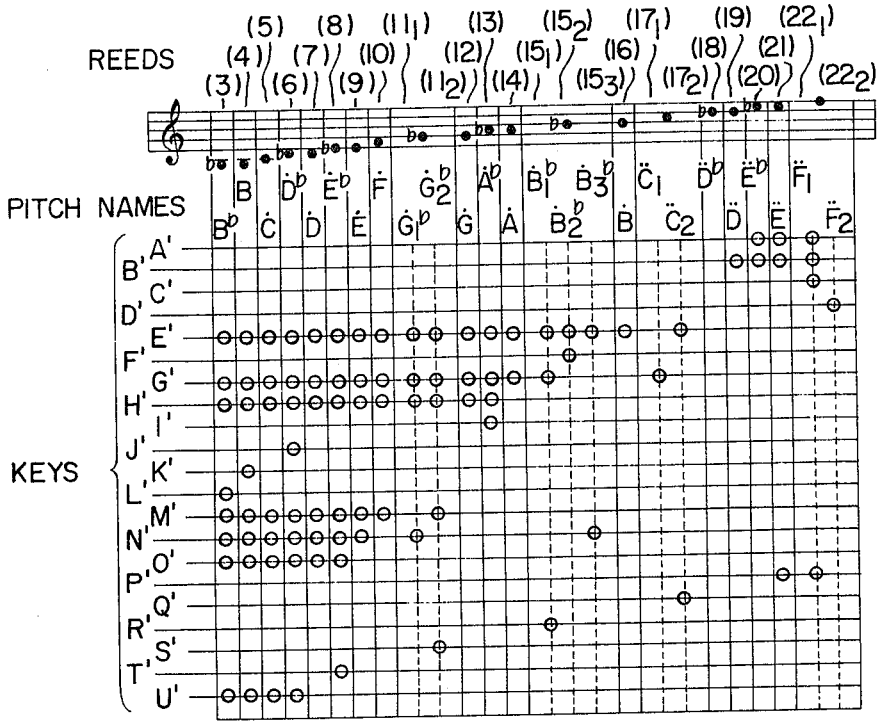
FIG. 2 is a fingering table for playing the saxophone.

FIG. 2 shows a fingering table for playing the saxophone, which is exactly same as the conventional fingering table. That is to say, this table indicates that, when the saxophone is blown at its mouthpiece 2 with the wind instrument being in a full open state, that is to say, none of the playing keys A' to U' is manipulated, a tone of $\ddot{D}^{\flat}$ is produced; when the keys E', G', and H' are depressed, while blowing the instrument, a tone of $\dot{G}$ is produced; and when the keys E', G', H', L', M', N', O' and U' are depressed, while blowing the same, a tone of $B^{\flat}$ is produced. Same operations are applicable when making tones of $B^{\flat}$ to $\ddot{F}_2$.

Figure 4:
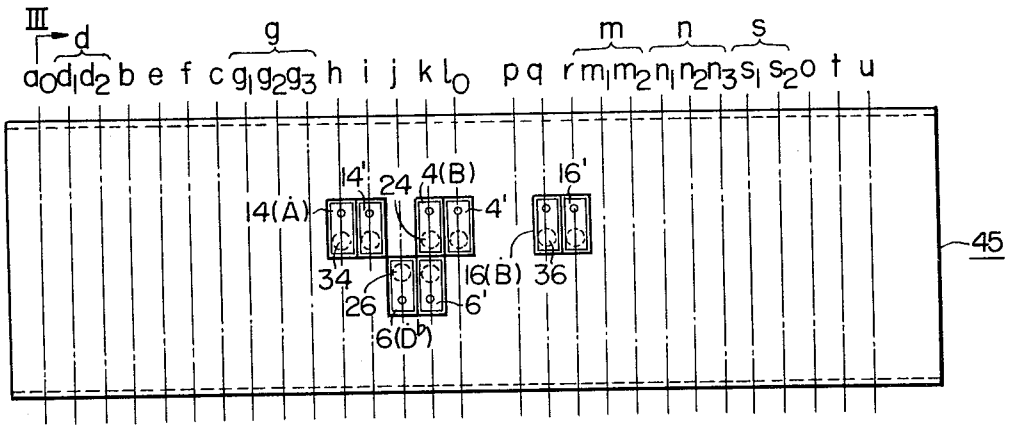
FIG. 4 is a plan view of a plate for fitting an upper sound producing member shown in FIG. 3 and as viewed along a cut line IV—IV in FIG. 10 to be referred to later.
Figure 5:
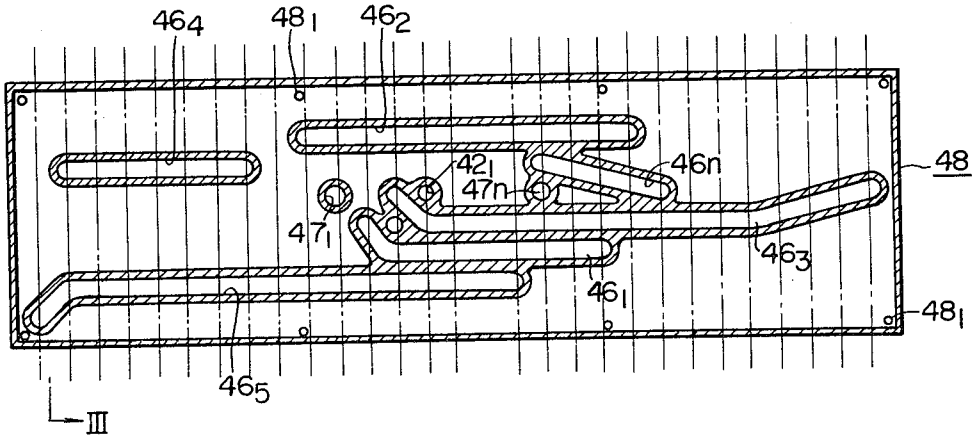
FIG. 5 is a plan view of a plate for forming an upper air passageway as shown in FIG. 3 and as viewed along a cut line V—V in FIG. 10 to be referred to later.
Figure 6:
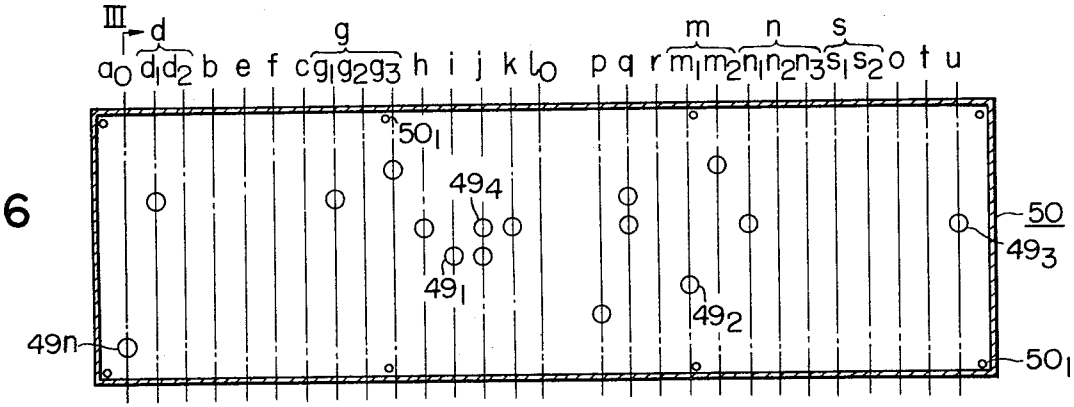
FIG. 6 is also a plan view of an upper plate for a valve box shown in FIG. 3 and as viewed along a cut line VI—VI in FIG. 10 to be referred to later.
Figure 7:
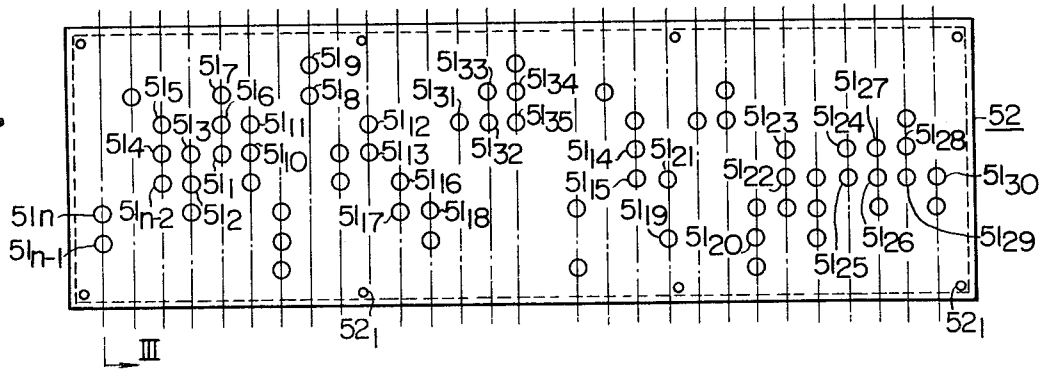
FIG. 7 is a plan view of a lower plate for a valve box shown in FIG. 3 and as viewed along a cut line VII—VII in FIG. 10 to be referred to later.
Figure 9:
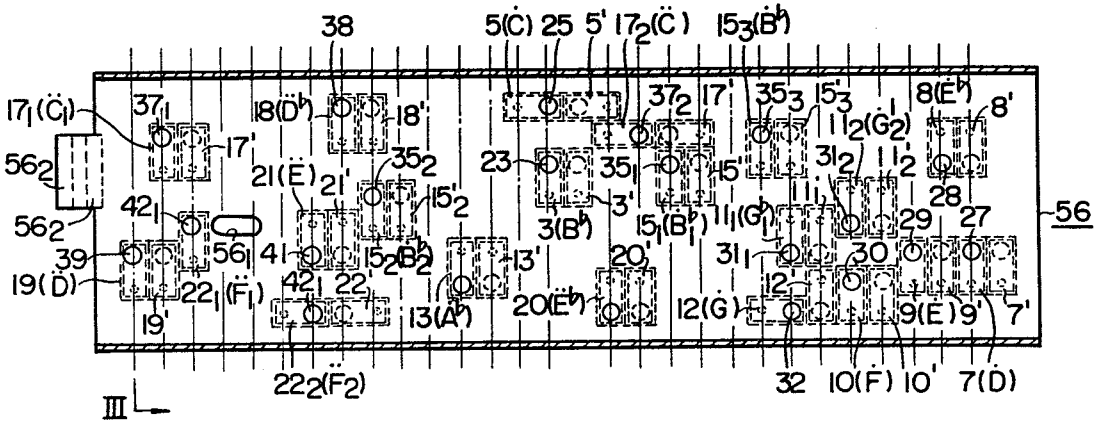
FIG. 9 is a plan view of a plate for fitting a lower sound producing member shown in FIG. 3 and as viewed along a cut line IX—IX in FIG. 10 to be referred to later.

For the purpose of the present invention, when the abovementioned group of playing or scale operation keys A' to U' are to be manipulated in accordance with the fingering table shown in FIG. 2, a plurality of pneumatic sound producing members 4, 6, 14, and 16 which produce tones of B, $D^{\flat}$, A, and B, respectively, are provided on an upper plate 45 of an air passageway forming box 43 as shown in FIG. 4. A plurality of pneumatic sound producing members 3, 5, 7–10, $11_1$, $11_2$, 12, 13, $15_1$–$15_3$, $17_1$, $17_2$, 18–21, $22_1$, and $22_2$ which produce tones of $B^{\flat}$, $\dot{C}$, $\dot{D}$–$\dot{F}$, $\dot{G}^{\flat}_1$, $\dot{G}^{\flat}_2$, $\dot{G}$, $\dot{A}^{\flat}$, $\dot{B}^{\flat}_1$–$\dot{B}^{\flat}_3$, $\ddot{C}_1$, $\ddot{C}_2$, $\ddot{D}^{\flat}$–$\ddot{E}$, $\ddot{F}_1$ and $\ddot{F}_2$, respectively, are provided on a lower plate 56 of the air passageway forming box 43 as shown in FIG. 9. These sound producing members are made of a reed as that used in harmonica, or pipe, or the like.

Although the conventional saxophone is played by manipulating the scale operation keys A' to U' in accordance with a given finger action to open and close the side ports, while blowing the instrument at its mouthpiece 2, the wind instrument according to the present invention is to form an air passageway which reaches any one of the sound producing members 3 to $22_2$ in correspondence to the finger action by the operation of the air valves $a_0$ to u to be actuated responsively to the keys A' to U', respectively. The box 43 to form this air passageway, as shown in FIGS. 3 to 11, is fitted inside the cylindrical main body 1 of the wind instrument by means of a hanger device 44. The air passageway forming box 43 consists of the plate 45 (see FIG. 4) for fixing the upper sound producing members 4 to 16, 4' to 16', and having therein a plurality of perforated holes 24 to 36 respectively facing to the sound producing members 4 to 16 of a low octave; a plate 48 (see FIG. 5) having a plurality of groove-shaped air passageways $46_1$ to $46_n$ and perforated holes $47_1$ to $47_n$; an upper surface plate 50 for the valve box (see FIG. 6) having a plurality of perforated holes $49_1$ to $49_n$; a lower surface plate 52 for the valve box (see FIG. 7), similar to the upper surface plate 50 in FIG. 6, having a plurality of perforated holes $51_1$ to $51_n$; a plate 55 (see FIG. 8) having a plurality of groove-shaped air passageways $53_1$ to $53_n$, and a plurality of perforated holes $54_1$ to $54_n$; and the plate 56 (see FIG. 9) for fixing the lower sound producing members 3 to $22_2$, 3' to $22_2'$, and having therein a plurality of perforated holes 23 to $42_2$ respectively facing to the sound producing members 3 to $22_2$ of a low octave.

The perforated holes 24 to 36 and 23 to $42_2$ formed in the upper and lower plates for fixing the upper and lower sound producing members, respectively, are opposed to the perforated holes $47_1$ to $47_n$, and $54_2$ to $54_n$ formed in the plates 48 to 55, respectively. Also, the perforated holes $49_1$ to $49_n$ and $54_1$ to $51_n$ (except for the hole $51_2$) formed in both upper and lower surface plates 50 and 52 for the valve box are opposed to the perforated holes or grooves of the plates 48 and 55. The respective plates 48, 50, 52 and 55 are assembled into a box shape in an air-tight or hermetic manner by means of screw threaded bolts inserted into a plurality of holes $48_1$ to $55_1$. In this case, it is preferable that a sealing member be interposed in the connecting portions between the adjacent plates. On the outer surfaces of the groove-shaped air passageway forming plates 48 and 55 in both upper and lower parts thereof, there are placed respective plates 45 and 56 for fixing both upper and lower sound producing members in an air-tight, and yet, slidable manner. At both ends of the fixing plates 45 and 56, there are applied band plates $45_1$ (see FIG. 10) which are fixed thereonto by screw threaded bolts. A hanger 44 is extended between the cylindrical main body barrel 1 and the assembled box portion of the plates 48, 50, 52, and 55 constituting the abovementioned air passageway forming box 43, and is fixed at both ends thereof to the main body 1 and the box 43 by threaded screw bolts. Two pieces of projected parts $56_2$ and $56_2$ are provided on the bottom surface of the abovementioned fixing plate 56 for the lower sound producing members. The tip end of the octave key V' is engaged with a space formed between these two projected parts $56_2$ and $56_2$.

Figure 3:
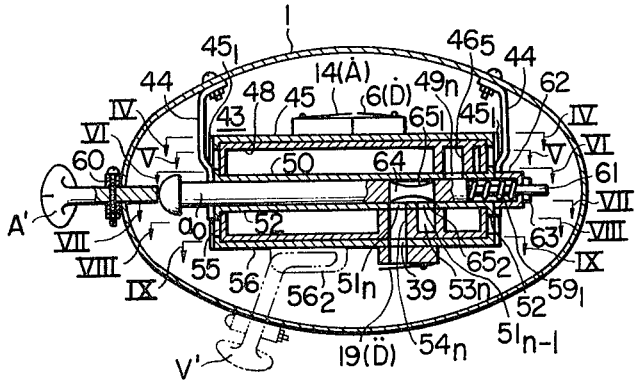
FIG. 3 is a cross-sectional view of the saxophone shown in FIG. 1 taken along a line III—III therein.
Figure 10:
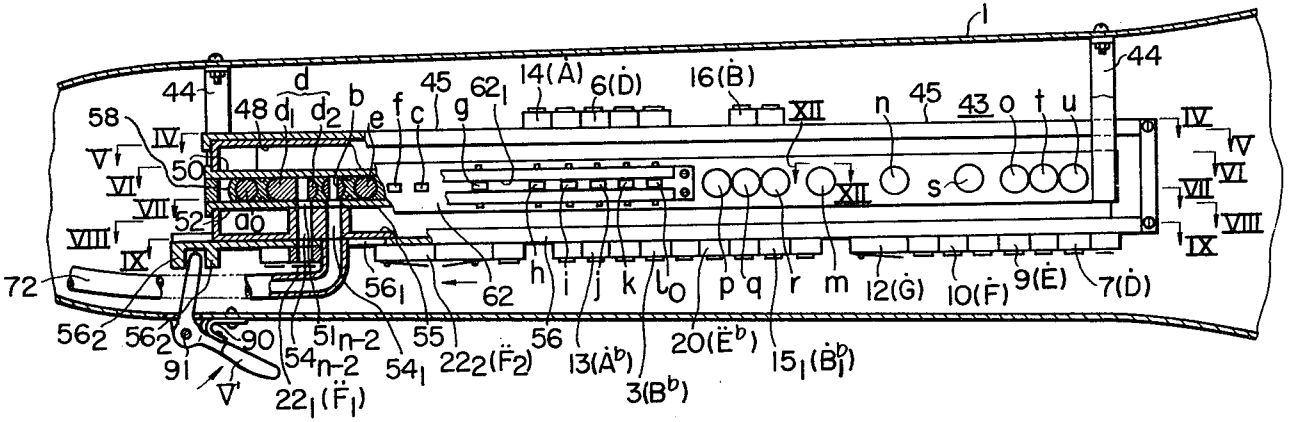
FIG. 10 is a longitudinal cross-sectional view of the saxophone shown in FIG. 1 taken along a line X—X, from which the scale operation keys are omitted.
Figure 11:
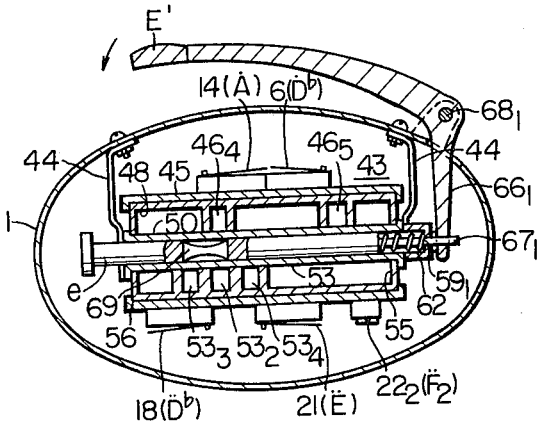
FIG. 11 is a cross-sectional view of the saxophone taken along a line XI—XI in FIG. 1.

The upper surface plate 50 and the lower surface plate 52 of the valve box constitute an integral valve box 57 as shown in FIGS. 3, 10, and 11. Within this valve box 57, there are provided a plurality of cylindrical barrels 58. Into each of these cylindrical barrels 58, there is slidably inserted a piston-shaped, air passageway change-over valve ($a_0$ to *c, e, f, h* to $l_0$, *n* to *r, t,* and *u*) having an air passage hole and to be operated by any of the scale operation keys E', F', H' to L', N' to R', T', and U', except for the keys D', G', M', and S'. Further, each of the air passageway change-over valves $a_0$ to *c, j* to $l_0$, *p* to *r, t,* and *u* is pushed outside by a return spring $59_1$ provided at the tail end part of the valve rod, hence the head part thereof is applied to the cam portion at the tip end of the lever-shaped keys corresponding to the respective change-over valves, and the respective keys are pushed backward by pressure to its initial position by the rotation of the keys around the axis 60 as the center of rotation. The tail end part 61 of each of the pistonshaped air passageway change-over valves $a_0$ to *c, e, f, h* to $l_0$, *n* to *r, t,* and *u* is formed in a rectangular cross-section. The rectangular end part in each of the change-over valves is inserted into and engaged with a groove $62_1$ of the frame 62 fixed to the valve box 57 so as to prevent the valve rod from rotating, and is further fixed by a pin 63 so as not to slip out of the groove $62_1$ unexpectedly. However, this rotation-preventive stopper device may be of any arbitrary construction such as a sliding key mechanism provided between the air passageway change-over valve and the cylindrical barrel 58 formed in the valve box 57, and other appropriate mechanism. For example, the air passageway change-over valve $a_0$ shown in FIG. 3, in its non-operated conditions, causes the air passage hole 64 and the dish-shaped portions $65_1$ and $65_2$ in both upper and lower portions thereof to be opposed to the perforated holes $51_n$ and $51_{n-1}$ of the lower surface plate 52 of the valve box, whereby the air passageway is formed in the sequence of: the groove $53_n$ of the plate 55 — the perforated holes $51_{n-1}$ of the plate 52 — a concave or dish-shaped portion $65_2$ of the valve $a_0$ — the perforated hole $54_n$ of the plate 52 — the perforated hole $54_n$ of the plate 55 — the perforated hole 39 of the plate 56 — the sound producing member 19. When the scale operation key A' is depressed to push forward the air passageway change-over valve $a_0$ against force of the spring $59_1$, a different channel for the air passage is then created in the sequence of: the groove $46_5$ of the plate 48 — the perforated hole $49_n$ of the plate 50 — the perforated hole 64 of the valve $a_0$ — the perforated hole $51_{n-1}$ of the plate 52 — the groove $53_n$ of the plate 55.

Similarly, the other air passageway change-over valves *b* to *e, j* to $l_0$, *p* to *r, t,* and *u* are provided with the air passage holes or ports which contribute to the formation of still another channel for the air passage to be described later by manipulation of the scale operation keys. The fitting relationship between the playing key E' and the air passageway change-over valve *e* therefor is such that, as shown in FIG. 11, the tip end of a lever $66_1$ of the playing key in the shape of a letter "L" is caused to be engaged with the perforated hole $67_1$ formed in one end part of the air passageway change-over valve *e*. In this structure, when the playing key E' is depressed to cause the lever to rotate around a shaft $68_1$ as the center of rotation, the air passageway change-over valve *e* is pulled against force of a spring $59_1$, whereby the channel for the air passage is formed. The other playing keys F', H' and 0' are of the same construction as that of the playing key E'. A reference numeral 69 designates the air passage hole formed in the change-over valve *e*.

Since, in the present invention, the air passageway which produces similar musical scale to that of the saxophone can be formed by the same finger action for playing the wind instrument, the playing keys D', G', M', N', and S' are so constructed that two or more numbers of the air valves may be opened and closed by a single playing key.

Figure 12:
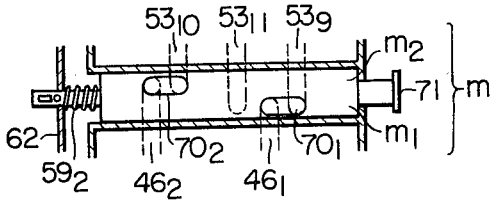
FIG. 12 is a longitudinal cross-sectional view of a change-over valve for selecting the air passageway taken along a line XII—XII in FIG. 10.
Figure 13:
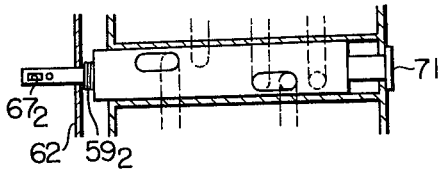
FIG. 13 is a schematic diagram for explaining the operations of the change-over valve shown in FIG. 12.

FIGS. 12 and 13 indicate, as one example of the above-described construction, the air passageway change-over valves $m_1$ and $m_2$ which are interlocked with a playing key m'. In the illustrated embodiment, the valve bodies $m_1$ and $m_2$ (hereinafter referred to generally as "*m*", where necessary) are formed integrally, in parallel with which the air passage holes $70_1$ and $70_2$ are formed. It is, of course, possible that the valve bodies are formed separately, and not integrally.

The fitting relationship between the scale operation key M' and the air passageway change-over valve *m* is similar to that in the above-described scale operation key E', and so forth. That is to say, the tip end of the L-shaped lever is caused to be engaged with the perforated hole $67_2$ formed at one end part of the air valve *m*. In this construction, when the scale operation key M' is depressed to cause the lever to rotate around the shaft $68_2$ as the center of rotation, the air passageway change-over valve *m* moves against force of the spring $59_2$, whereby the channel for the air passage formed in the sequence of: the groove $53_9$ of the plate 55 — the air passage hole $70_1$ of the air passageway change-over valve *m* — the groove $46_1$ of the plate 48 — the groove $53_{10}$ of the plate 55 — the air passage hole $70_2$ of the air passageway change-over valve *m* — the groove $46_2$ of the plate 48 is changed-over by the air passage holes $70_1$ and $70_2$ to another channel for the air passage to be formed in the sequence of: the groove $53_{11}$ of the plate 55 — the air passage hole $70_1$ of the air passageway change-over valve *m* — the groove $46_1$ of the plate 58 — the air passage hole $70_2$ of the air passageway change-over valve *m* — the groove $46_2$ of the plate 48. A reference numeral 71 designates a stopper for the air passageway change-over valve *m*. The air passage holes $70_1$ and $70_2$ may be provided in series, although, in this case, the positions of the groove-shaped air passageway and the perforated holes to be described later also change.

Figure 8:
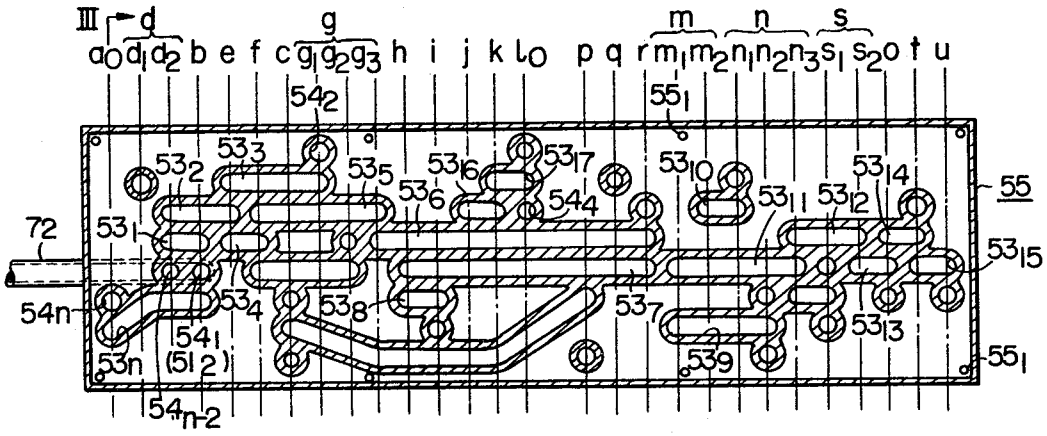
FIG. 8 is a plan view of a plate for forming a lower air passageway as shown in FIG. 3 and as viewed along a cut line VIII—VIII in FIG. 10 to be referred to later.

The abovementioned mouthpiece 2 and the perforated hole $54_1$ of the groove-shaped air passageway plate 55 at the lower part are connected each other by a tubing 72 through a long through-hole $56_1$ provided at the fitting plate 56 for the lower sound producing member, as shown in FIGS. 8 and 10. A reference numeral $72_1$ designates a connecting tube between the mouthpiece 2 and the tubing 72. A breath is sent from this mouthpiece 2 into the valve box, and the group of the scale operation keys A' to U' are manipulated in accordance with the fingering table shown in FIG. 2, whereupon the relevant air passageway change-over valves $a_0$ to *u* are actuated to become communicable with the perforated holes and the groove-shaped air passageway formed in the plates 45, 48, 50, 52, 55, and 56, whereby there is formed the air passageway leading to the sound producing members 3 to $22_2$ corresponding to the finger actions, and the relevant tones B♭ to $\ddot{F}_2$ are produced.

Figure 14:
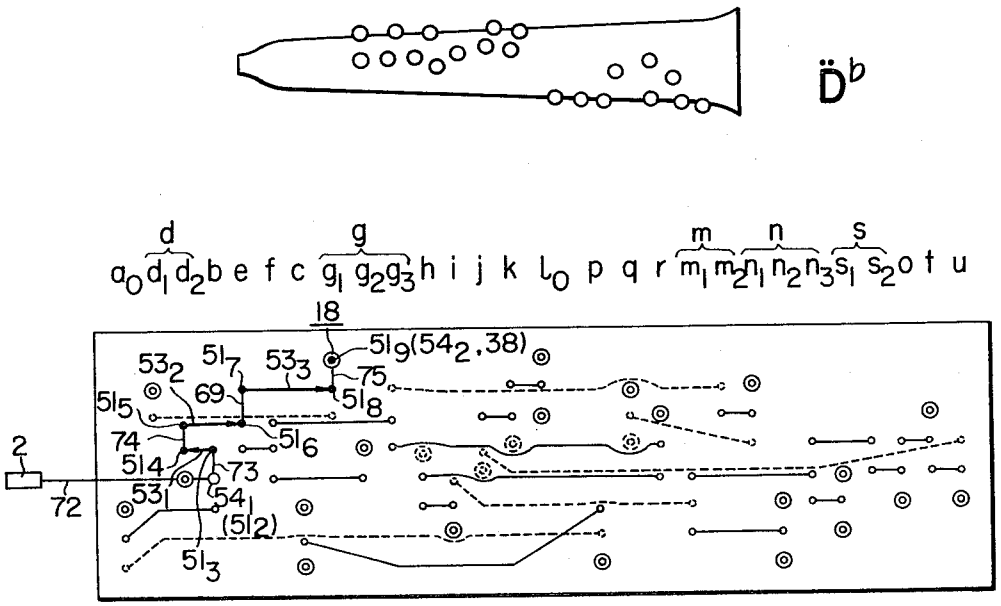
FIGS. 14, 15, and 16 are explanatory diagrams of various finger actions of the scale operation keys to play the saxophone and established channel for the air passageways corresponding to the finger action.

In the following, various examples of the finger actions will be explained with reference to FIGS. 14 to 16. In FIGS. 14 and 16, thick solid lines in the vertical (up-and-down) direction in the air passageway represent the air passage holes for the air passageway change-over valves *b*, $d_2$, *e*, and $g_1$; solid lines in the horizontal (left-and-right) direction in the air passageway represent the air passageway for the groove-shaped air passageway forming plate 55 at the lower part; and dotted lines in the horizontal (left-and-right) direction denote the air passageway for the groove-shaped air passageway forming plate 48 at the upper part.

Finger Action 1 (D̈♭ tone — FIG. 14)

When air is blown into the valve box of the instrument in its full open state, wherein no scale operation keys A' to U' are manipulated, the air passageways as shown in the thick solid lines are formed, and the sound producing member 18 (for the tone of D̈♭) fitted on the lower surface of the fitting plate 56 is actuated to produce the tone.

In this case, formation of the air passageways to produce the tone of D̈♭ is in the following sequence: mouthpiece 2 — tubing 72 — perforated holes $54_1$ of the plate 55 — perforated hole $51_2$ of the plate 52 matched with the perforated hole $54_1$ thereof — the air passage hole 73 of the valve *b* — the perforated hole $51_3$ of the plate 52 — the groove $53_1$ of the plate 55 — the perforated hole $51_4$ of the plate 52 — the air passage hole 74 of the valve $d_2$ — the perforated hole $51_5$ of the plate 52 — the groove $53_2$ of the plate 55 — the perforated hole $51_6$ of the plate 52 — the air passage hole 69 of the valve *e* — the perforated hole $51_7$ of the plate 52 — the groove $53_3$ of the plate 55 — the perforated hole $51_8$ of the plate 52 — the air passage hole 75 of the valve $g_1$ — the perforated hole $51_g$ of the plate 52 — the perforated hole $54_2$ of the plate 55 — the perforated hole 38 of the plate 56 matched with the perforated hole $54_2$ thereof — the sound producing member 18.

Figure 15:
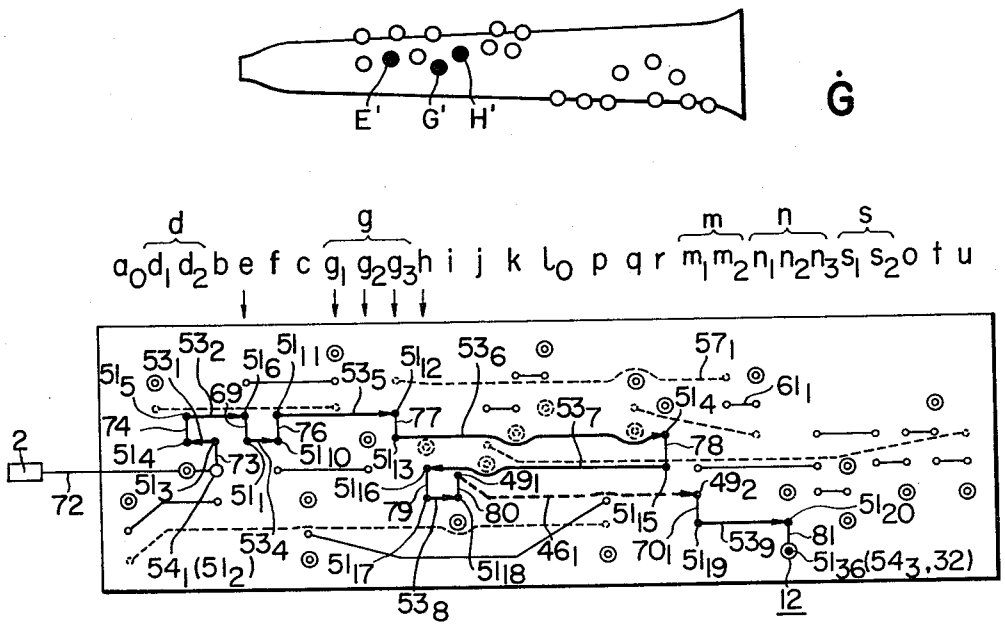
Figure 16:
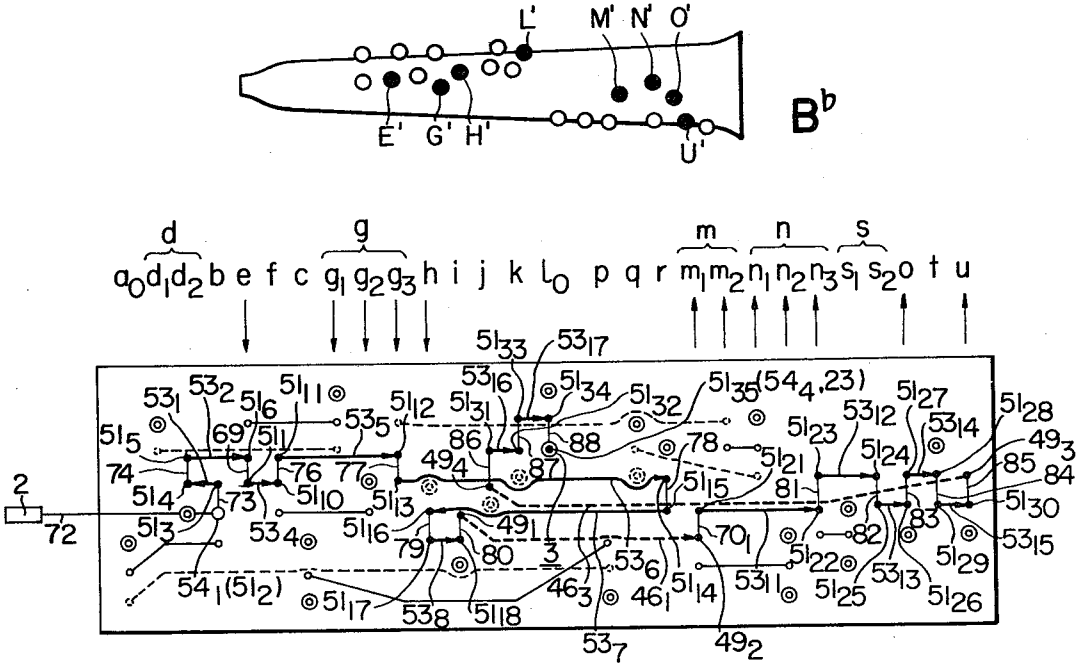

Finger Action 2 (Ġ tone — FIG. 15)

When the scale operation keys E', G', and H' are depressed, the air passageway change-over valves *e*, $g_1$, $g_2$, $g_3$, and *h* move in the directions of the arrow marks, whereby the air passageways shown by thick solid lines are formed.

In this case, formation of the air passageways to produce the tone of Ġ is in the following sequence. From the mouthpiece 2 to the air passage hole 69, the same sequence of the above-described finger action 1 is followed, after which the air passage route follows the sequence of: the perforated hole $51_1$ of the plate 52 — the groove $53_4$ of the plate 55 — the perforated hole $51_{10}$ of the plate 52 — the air passage hole 76 of the valve *f* — the perforated hole $51_{11}$ of the plate 52 — the groove $53_5$ of the plate 55 — the perforated hole $51_{12}$ of the plate 52 — the air passage hole 77 of the valve $g_3$ — the perforated hole $51_{13}$ of the plate 52 — the groove $53_6$ of the plate 55 — the perforated hole $51_{14}$ of the plate 52 — the air passage hole 78 of the valve *r* — the perforated hole $51_{15}$ of the plate 52 — the groove $53_7$ of the plate 55 — the perforated hole $51_{16}$ of the plate 52 — the air passage hole 79 of the valve *h* — the perforated hole $51_{17}$ of the plate 52 — the groove $53_8$ of the plate 55 - the perforated hole $51_{18}$ of the plate 52 — the air passage hole 80 of the valve *i* — the perforated hole $49_1$ of the plate 50 (FIG. 6) — the groove $46_1$ of the plate 48 (FIG. 5) — the perforated hole $49_2$ of the plate 50 — the air passage hole $70_1$ of the valve $m_1$ — the perforated hole $51_{19}$ of the plate 52 — the groove $53_9$ of the plate 55 — the perforated hole $51_{20}$ of the plate 52 — the air passage hole 81 of the valve $n_2$ — the perforated hole $51_{36}$ of the plate 52 — the perforated hole $54_3$ of the plate 55 — the perforated hole 32 of the plate 56 matched with the hole $54_3$ thereof — the sound producing member 12.

Finger Action 3 (B♭ tone — FIG. 16)

When the scale operation keys E', G', H', L', M', N', 0', and U' are depressed, the air passageway change-over valves *e*, $g_1$, $g_2$, $g_3$, *h*, *l*, $m_1$, $m_2$, $n_1$, $n_2$, $n_3$, *o*, and *u* move in their respective directions indicated by arrow marks, whereby the air passageways shown by the thick solid lines are formed.

In this case, formation of the air passageways to produce the tone of B♭ is in the following sequence. From the mouthpiece 2 to the perforated hole $49_2$ of the plate 52, the same sequence of the above-described finger action 2 is followed, after which the air passage route follows the sequence of: the air passage hole $70_1$ of the valve $m_1$ — the perforated hole $51_{21}$ of the plate 52 — the groove $53_{11}$ of the plate 55 — the perforated hole $51_{22}$ of the plate 52 — the air passage hole 81 of the valve $n_3$ — the perforated hole $51_{23}$ of the plate 52 — the groove $53_{12}$ of the plate 55 — the perforated hole $51_{24}$ of the plate 52 — the air passage hole 83 of the valve $s_2$ — the perforated hole $51_{25}$ of the plate 52 — the groove $53_{13}$ of the plate 55 — the perforated hole $51_{26}$ of the plate 52 — the air passage hole 84 of the valve *o* — the perforated hole $51_{27}$ of the plate 52 — the groove $53_{14}$ of the plate 55 — the perforated hole $51_{28}$ of the plate 52 — the air passage hole 84 of the valve *t* — the perforated hole $51_{29}$ of the plate 52 — the groove $53_{15}$ of the plate 55 — the perforated hole $51_{30}$ of the plate 52 — the air passage hole 85 of the valve *u* — the perforated hole $49_3$ of the plate 50 (FIG. 6) — the groove $46_3$ of the plate 48 (FIG. 5) — the perforated hole $49_4$ of the plate 50 — the air passage hole 86 of the valve *j* — the hole $53_{31}$ of the plate 52 — the groove $53_{16}$ of the plate 55 — the hole $51_{32}$ of the plate 52 — the air passage hole 87 of the valve *k* — the perforated hole $51_{33}$ of the plate 52 — the groove $53_{17}$ of the plate 55 — the perforated hole $51_{34}$ of the plate 52 — the air passage hole 88 of the valve $l_0$ — the perforated hole $51_{35}$ of the plate 52 — the perforated hole $54_4$ of the plate 55 — the perforated hole 23 of the plate 56 matched with the perforated hole $54_4$ thereof — the sound producing member 3.

In any other finger actions shown in FIG. 2, the air passageway is formed by the same way as in the above-described examples 1 to 3 of the finger action, whereby the tones of $B^\flat$ to $F_2$ can be respectively produced.

Thus, the wind instrument according to the present invention can be played in exactly the same finger actions as in playing the saxophone, in which various tones can be obtained by interchanging the sound producing member such as reed or pipe, and the like. Moreover, as the wind instrument of the present invention can be played with a small breath, a high skill in playing the wind instrument can be acquired at a minor age. Also, since the pitch of the tone is irrelevant to the length of the air passageway, the cylindrical main body barrel 1 can be designed in an arbitrary shape and size, with only consideration being given to resonance of the sound produced in the tubular body.

When the octave is to be raised, the octave key V′ is caused to rotate in the arrow direction against force of the plate spring 90 with the pin 91 as the center of rotation, whereupon the tip end of the octave key is engaged with the projections $56_2$ and $56_2$ of the fitting plate 52 for fitting the lower sound producing member, whereby the fitting plates 45 and 56 for both upper and lower sound producing member move together in the arrowed direction for a predetermined space interval. By this displacement of the fitting plates 45 and 56, the sound producing members 3′ to $22_2'$ of higher octave become opposed to the perforated holes 24 to 36 and 23 to $42_2$ of the fitting plates 45 and 56, whereby the playing of the instrument at a higher octave becomes possible. When the octave key V′ is released, the abovementioned fitting plates 45 and 56 return to their original positions by the restitutive force of the plate spring 90. The displacement of the fitting plate 56 for the lower sound producing member with respect to the tube 72 is made possible by the long through-hole $56_1$ formed in the plate 56. When the air passageway forming box 43 is to be cleaned, this can be done by first removing the threaded screw bolts which connect the hanger 44 and the cylindrical main body barrel 1, then disconnecting the mouthpiece 2 and the tube 72, subsequently disengaging each scale operation key and the air passageway change-over valve or the projection corresponding to each other, and finally drawing out the air passageway forming box 43 from the opening 92 of the instrument body. In this way, when the air passageway forming box 43 is made in a cassette type which is freely insertable and retractable, not only the cleaning work becomes easy, but also the playing of the instrument can be made versatile by simple interchanging operation of the sound producing member fitting plate provided thereon with the sound producing members of different tone quality and scale, and so forth.

In the following, the present invention will be further explained with reference to a trumpet having three piston type scale operation keys as the representative example of the valve control type wind instrument having less number of scale operation or playing keys.

Figure 17:
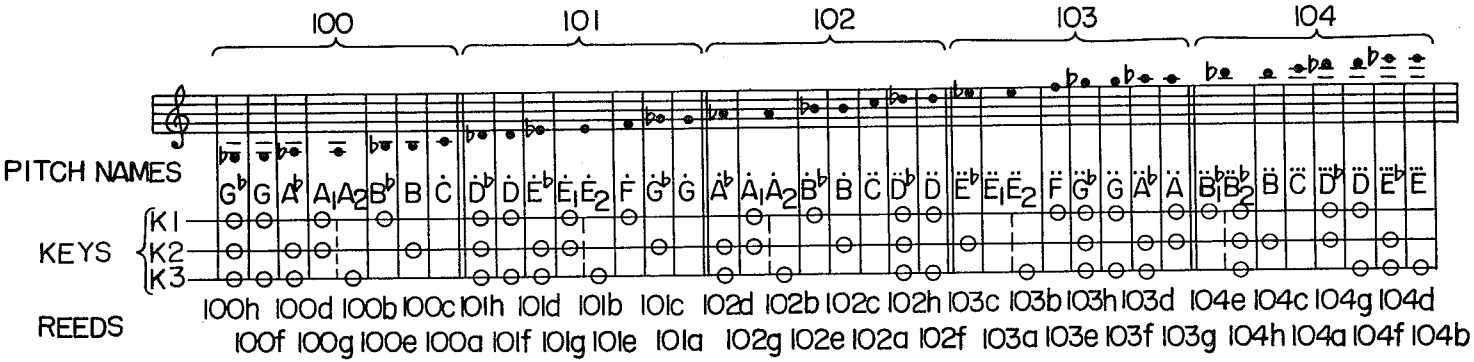
FIG. 17 is a fingering table for playing a trumpet.

Referring to FIG. 17, which shows the fingering table for the trumpet, the playing keys and the tone to be produced are in such a relationship that, when the playing keys K1 to K3 are not depressed, the tones $C'$, $C''$, and $C'''$ are produced for the musical scale sections of 100, 102, and 104, the tone G for the scale section 101, the tone $E_1''$ for the scale section 103; when the playing key K1 is depressed, the tones $B^\flat$, $B'^\flat$, and $B''^\flat$ are produced for the respective scale sections 100, 102, and 104, the tone $F'$ and $F''$ respectively for the scale sections 101 and 103; and, when the playing keys K1 and K2 are depressed, the tones $A_1$, $A_1'$, and $A''$ are produced for the scale sections 100, 102, and 103, respectively, the tone $E_1'$ for the scale section 101, and the tone $D''^\flat$ for the scale section 104.

Figure 18:
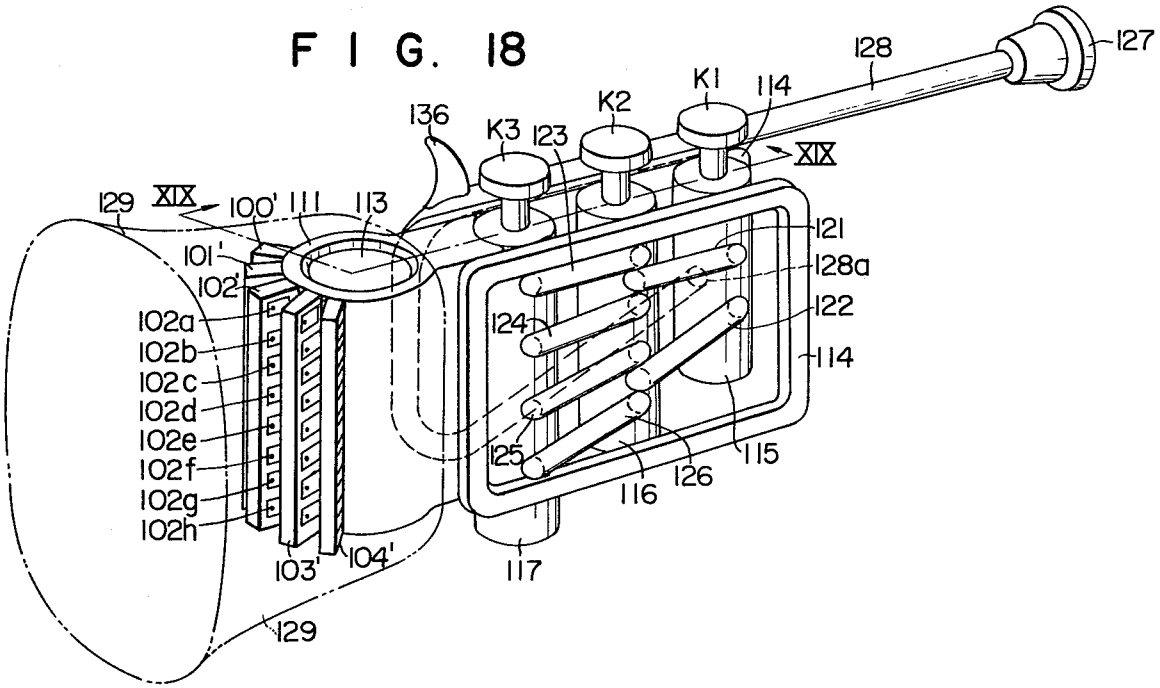
FIG. 18 is a perspective view showing an outer appearance of a trumpet.
Figure 19:
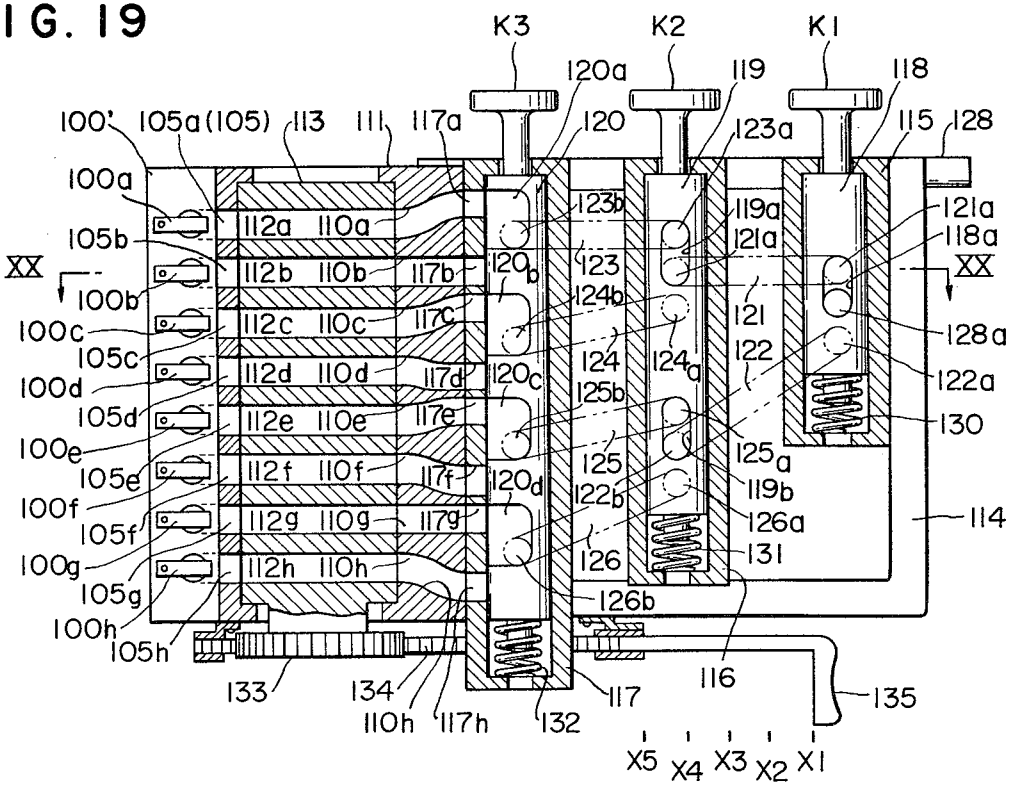
FIG. 19 is a longitudinal cross-sectional view of the main part of the trumpet taken along a line XIX—XIX in FIG. 18.
Figure 20:
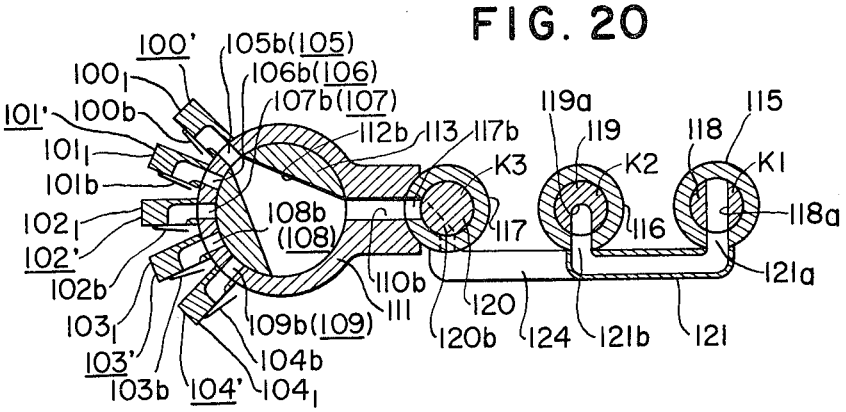
FIG. 20 is a cross-sectional view of the main part of the trumpet taken along a line XX—XX in FIG. 19.
Figure 22:
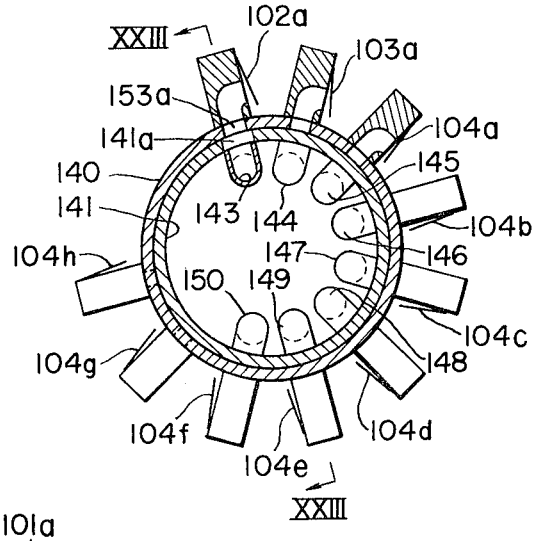
FIG. 22 is a cross-sectional view of the arrangement of the sound producing members in the trumpet shown in FIG. 21 taken along a line XXII—XXII.
Figure 23:
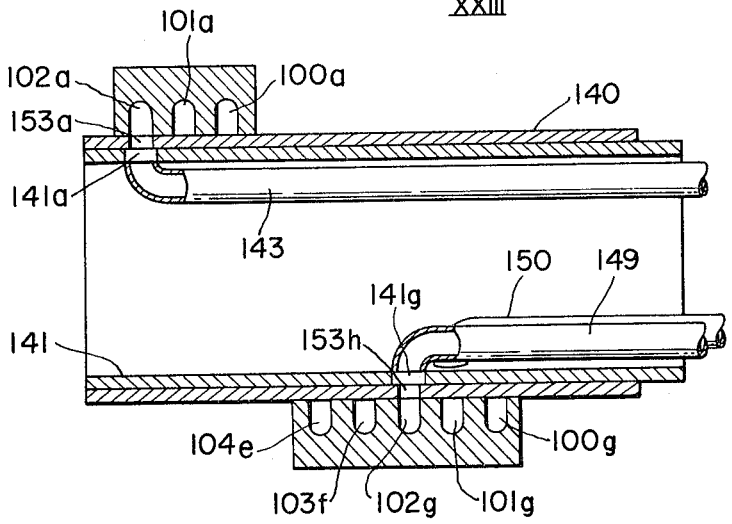
FIG. 23 is a longitudinal cross-sectional view showing arrangement of the sound producing member in the trumpet taken along a line XXIII—XXIII in FIG. 22.

The trumpet according to the present invention, as shown in detail in FIGS. 18 to 20, is constructed with a group of sound producing members 100′ to 104′ which produce seven different tones for each musical scale of 100 to 104 as shown in the fingering table in FIG. 17; a cylindrical barrel 111 supporting on the outer peripheral portions thereof the group of the sound producing members 100′ to 104′ in five rows for the octave-wise and having a plurality of rows of perforated holes 105 (**105*a* through 105*h*), 106 (106*a* through 106*h*), 107 (107*a* through 107*h*), 108 (108*a* through 108*h*), and 109 (109*a* through 109*h*), each row of the perforated holes being opposed to each row of the sound producing members fitted and held on the peripheral surface portions of this cylindrical barrel 111, and a plurality of air passage holes 110*a* through 110*h*; a scale change-over valve 113 having a plurality of sector-shaped air passage holes 112*a* through 11*h* fittingly placed with the cylindrical barrel 111 in a rotatable manner; a key supporting frame 114 fitted onto a part of the cylindrical barrel 111; a plurality of playing keys K1, k2, and K3 having a plurality of cylinders 115, 116 and 117 fitted to and supported by the key holding frame 114 (the cylinder 117 being also fitted to and held on the cylindrical barrel 111); and piston type air passageway change-over valves 118, 119, and 120; a plurality of air passageway forming tubes 121, 122, 123, 124, 125, and 126 to communicatively connect each of the adjacent keys each other; a connecting tube 128 to connect the cylinder 115 of the single playing key K1 and a mouthpiece 127; and an opening section 129 in a tulip-shape covering the cylindrical barrel 111**.

Each of the abovementioned group of the sound producing members 100′ to 104′ is provided with eight reeds **100*a* through 100*h*, 101*a* through 101*h*, 102*a* through 102*h*, 103*a* through 103*h*, and 104*a* through 104*h***, which are fitted onto a plate $100_1$, $100_2$, $100_3$, and $100_4$ having air passageways corresponding in number to that of the reeds fitted in row with an appropriate space interval among them. Instead of the reed, a pipe may replace.

in the above-described construction of the trumpet, the piston type air passageway change-over valve 118 of the scale operation key K1 is urged upward by a spring 130, and the air passage hole 118*a* thereof is communicated to the openings 128*a* and 121*a* at one end of the tubes 128 and 121, respectively, while the valve closes the opening 122*a* at one end of the other tube 122. In the same manner, the air passageway change-over valve 119 of the scale operation key K2 is urged upwardly by a spring 131, and the two air passageways 119*a* and 11*b* are respectively communicated to the opening 123*a* at one end of the tube 123 and to the opening 121*b* at the other end of the tube 121 as well as to the opening 122*b* at the other end of the tube 122 and the opening 125*a* at one end of the tube 125, while they close the openings 124*a* and 126*a* at one end of the tubes 124 and 126, respectively. Again, the air passageway change-over valve 120 of the scale operation key K3 is similarly urged upward by a spring 132, and four air passage holes 120*a*, 120*b*, 120*c*, and 120*d* are communicated to the openings 123*b*, 124*b*, 125*b*, and 126*b* at the other end of the tubes 123, 124, 125, and 126, respectively, while these valves are also communicated to the perforated holes 117*a*, 117*c*, 117*e*, and 117*g* of the cylinder 117, and close the other perforated holes 117*b*, 117*d*, 117*f*, and 117*f* thereof. The perforated holes 117*a* through 117*h* of the cylinder 117 are further communicated to the air passage holes 110*a* through 110*h* of the cylindrical barrel 111, respectively.

In FIG. 19, a reference numeral 133 designates a gear integrally fitted to the afore-mentioned scale change-over valve 113, and a numeral 134 refers to a rack formed at one part of a lever 135 so as to be meshed with the gear 133. By reciprocatingly shifting this lever 135 in accordance with indexes X1 to X5 provided at the handle portion of the lever 135, the scale change-over valve 113 is caused to rotate in the clockwise direction as viewed in FIG. 20 so that the air passage holes 112*a* through 112*h* of the scale change-over valve 113 may be communicated to the perforated holes 105, 106, 107, 108, and 109 leading to the sound producing members in each of the musical scales 100, 101, 102, 103, and 104.

When a breath is blown into the valve box in the cylindrical barrel 111 from the mouthpiece 127 without the scale operation keys K1 to K3 shown in FIG. 20 being depressed and with the scale change-over valve 113 in a state of being matched with the index X1 (corresponding to the musical scale 100), the air passageway is formed in the following sequential channeling, and the tone C for the scale 100 is produced: the tube 128 — the opening 128*a* of the tube 128 — the air passage hole 118*a* of the air passageway change-over valve 118 — the tube 121 — the air passage hole 119*a* of the air passageway change-over valve 119 — the tube 123 — the air passage hole 120*a* of the air passageway change-over valve for the key K3 — the perforated hole 117*a* of the cylinder 117 — the perforated hole 110*a* of the cylindrical barrel 111 — the air passage hole 112*a* of the scale change-over valve 113 — the perforated hole 105*a* of the cylindrical barrel 111 — the sound producing member 100*a*.

When the scale change-over lever 135 is pushed forward to the position of the index X2 in FIG. 19, the scale change-over valve 113 is rotated by the scale change-over gear 133, whereby the air passage hole 112*a* through 112*h* become communicated to the perforated holes 106 (106*a* through 106*h*) which in turn lead to the group of row of the sound producing members at the scale 101. In this state, when a breath is blown into the cylindrical barrel from the mouthpiece, blown air is introduced into the sound producing member 101*a* through the abovementioned air passageway, and the tone G for the scale 101 is produced.

With the abovementioned valve position being maintained, when the scale operation keys K1 to k3 are depressed, the air passageway is formed in the following sequential channelling, and the tone D♭ for the scale 101 is produced: the tube 128 — the opening 128*a* of the tube 128 — the air passage hole 118*a* of the air passageway change-over valve 118 — the tube 122 — the air passage hole 119*b* of the air passageway change-over valve 119 — the tube 126 — the air passage hole 120*d* of the air passageway change-over valve 120 — the perforated hole 117*h* of the cylinder 117 — the perforated hole 110*h* of the cylindrical barrel 111 — the air passage hole 112*h* of the scale change-over valve 113 — the perforated hole 105*h* of the cylindrical barrel 111 — the sound producing member 101*h*.

Furthermore, with the playing keys K1 to K3 being maintained in their depressed state as mentioned in the preceding, when the scale change-over lever 135 is shifted to a position of the index X1, there will be formed the air passageway leading to the sound producing member 100*h*, and the tone of G♭ at the scale 100 is produced.

In the above-described manner, each and every tone as shown in FIG. 17 can be produced by changing-over the air passageway change-over valves 118 to 120 through the finger actions of the scale operation keys K1 to K3 and operations of the scale change-over lever 135, and by changing-over the air passageway leading to any of the rows of the group of sound producing members 100' to 104' through the scale change-over 113. Incidentally, a reference numeral 136 in FIG. 18 designates a finger hook.

Figure 21:
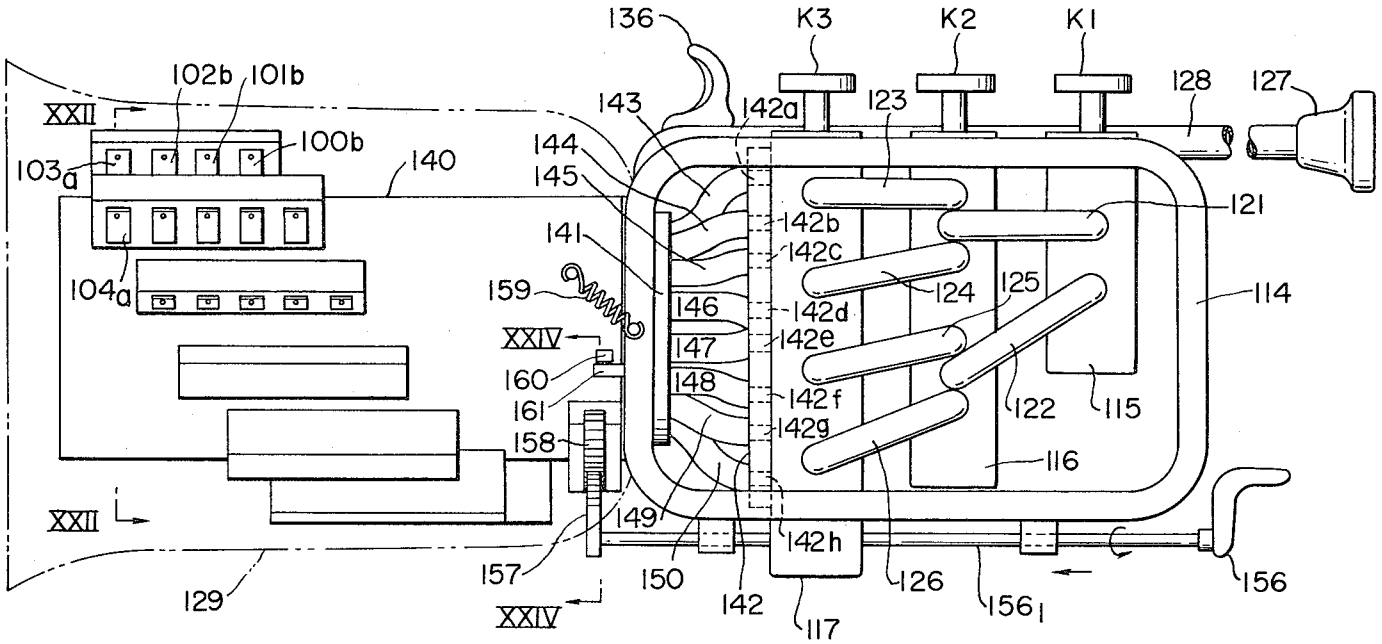
FIG. 21 is a schematic side elevational view of one modified embodiment of the trumpet.

FIG. 21 shows a modification of the above-described trumpet. In this modified embodiment, the constructions of the air passageway change-over valves for the scale operation keys K1 to K3, change-over valves, and the air passageways therefor, connections among the cylinders for the keys, and so forth are the same as those in the above-described embodiment.

Figure 25:
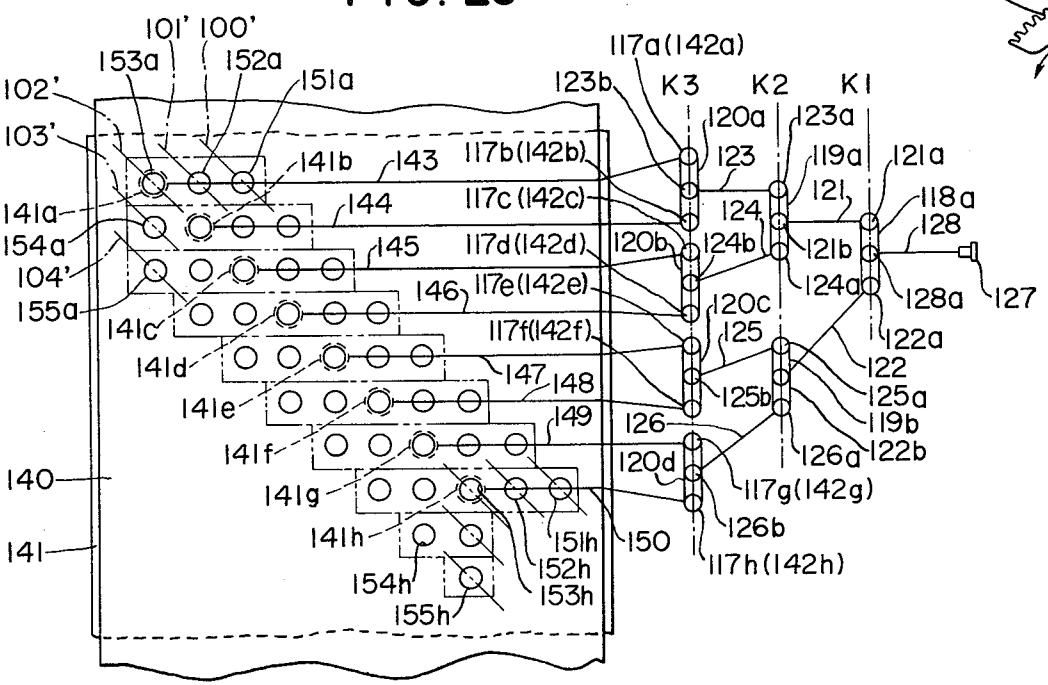
FIG. 25 is a developed view of the fitting portion of the sound producing members for the purpose of explaining the overall arrangement thereof.

In this modified embodiment, the cylindrical barrel 140 for fitting the sound producing members moves rotationally and sidewisely (in the left-and-right directions) with respect to the inner barrel 141. The inner barrel 141 is fixed at one end part of the supporting frame 114 for each playing key positioned at both side parts thereof. A plate 142 having therein the air passage holes 142*a* through 142*h* is fixedly provided on the cylinder 117 in a manner to coincide with the perforated holes 117*a* through 117*h* of the cylinder 117 of the scale operation key K3. The air passage holes 142*a* through 142*h* of the plate 142 and the perforated holes 141*a* through 141*h* which are formed in an oblique row in the inner barrel 141, as shown in FIG. 25 are connected each other by a plurality of air introducing tubes 143 through 150. The abovementioned cylindrical barrel 140 for fitting the abovementioned sound producing member is provided with a plurality of rows of perforated holes, each having eight holes for each musical scale. In the illustrated embodiment in FIG. 25, five rows of the holes, 151*a* through 151*h*, 152*a* through 152*h*, 153*a* through 153*h*, 154*a* through 154*h*, and 155*a* through 155*h*, are obliquely arranged on the outer peripheral surface of the cylindrical barrel 140. In this arrangement of the perforated holes, the row of the perforated holes in the horizontal direction, 151*a* to 153*a*, and the tow of the perforated holes in the vertical direction, 153*a* to 155*a*, as well as the tow of the perforated holes in the horizontal direction 151*h* to 153*h* and the row of the perforated holes in the vertical direction 153*h* to 155*h* are so formed that they may intersect orthogonally. A group of the sound producing members 100' to 104' for each musical scale which are similar to that shown in FIG. 17 are respectively provided in confrontation to the obliquely arranged rows of the perforated holes. The illustrated embodiment in FIG. 25 shows the cylindrical barrel 140 provided on the outer peripheral surface thereof with the sound producing members with the horizontal row as constituting one group.

Figure 24:
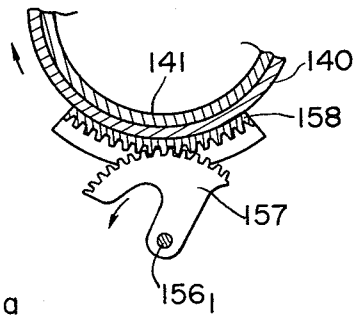

The shifting mechanism for the cylindrical barrel 140 for fitting the sound producing members consists of a lever 156, the shaft $\mathbf{156}_1$ of which is fitted onto the supporting frame 114 in both slidable and rotatable manners; an arcuate rack 157 which is mounted at the tip end of the lever 156 (vide FIG. 24); a gear member fixedly provided on one outer peripheral portion of the sound producing member fitting barrel 140 in a manner to be meshed with the rack 157; and a return spring 159 which is extended between one outside surface of the fitting barrel 140 and the supporting frame 114. Projections 160 and 161 for stopping further rotational movement of the fitting barrel 140 are respectively provided on the fitting barrel 140 and the supporting frame 114.

In the above-described construction, when the lever 156 is not operated, the sound producing members 102*a* through 102*h* for the musical scale 102 are communicated to the perforated holes 141*a* through 141*h* of the inner barrel 141, so that desired tone of the scale 102 can be produced by the finger action of the scale operation keys K1 to K3. When the lever 156 is rotated in the anti-clockwise direction in FIG. 24, the sound producing member fitting barrel 140 is rotated in the clockwise direction in FIG. 24 by the engagement of the arcuate rack 157 with the gear member 158, and the scale is changed-over to the octave 103 or 104. Further, when the lever 156 is pushed forward in the direction of the arrow (to the left side as viewed from the top surface of FIG. 21), the scale is changed-over to the octave 100 or 101. When the lever 156 is released, it returns to the original position, i.e., the scale 102, by the action of the return spring 159.

When the perforated holes 141*a* through 141*h* of the inner barrel 141 are aligned in the axial direction of the barrel 141 and the perforated holes of the sound producing member fitting barrel 140 are formed in parallel with the perforated holes of the inner barrel 141, the change-over of the musical scale can be done by merely rotating the sound producing member fitting barrel 140.

Figure 26:
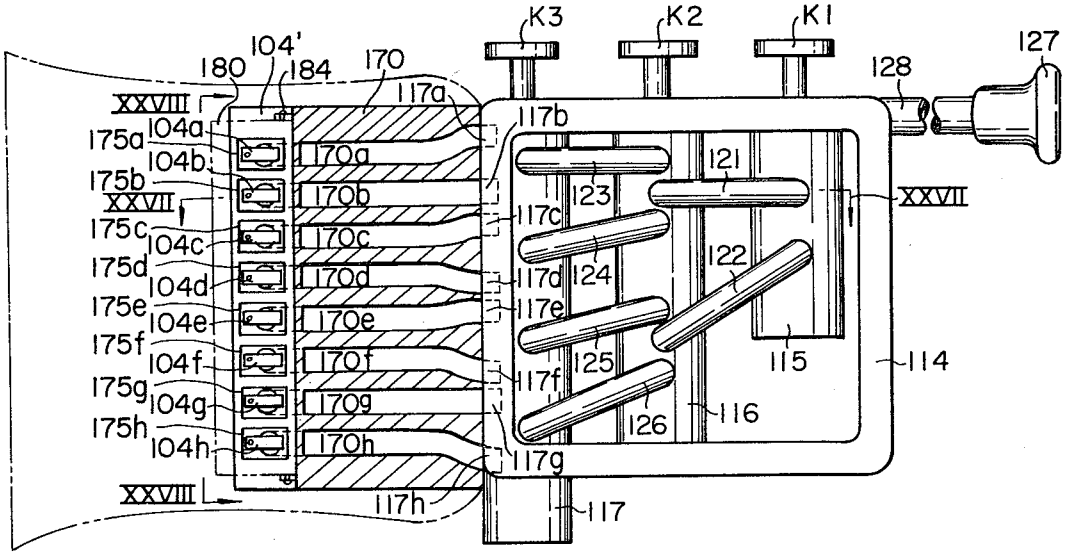
FIG. 26 is a schematic side elevational view of further modified embodiment of the trumpet according to the present invention.
Figure 27:
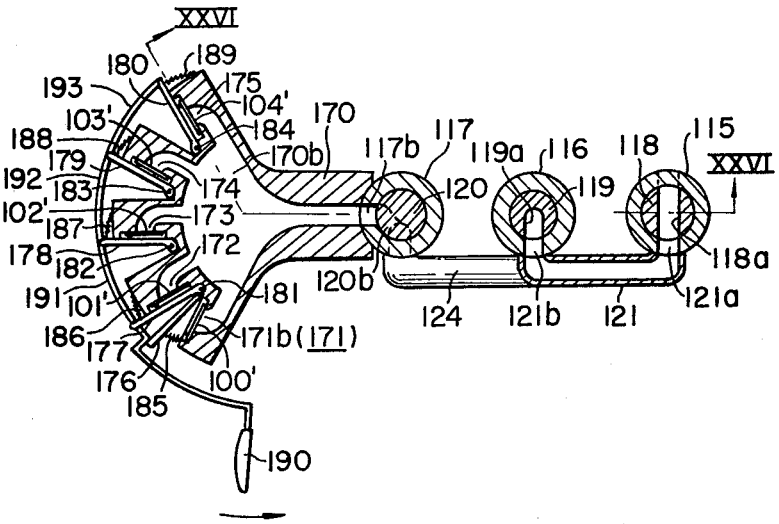
FIG. 27 is a cross-sectional view of the main part of the trumpet shown in FIG. 26 taken along a line XXVI—XXVI therein.
Figure 28:
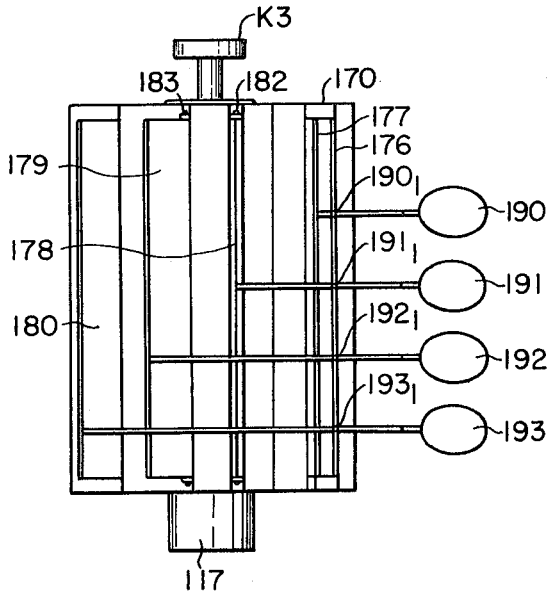
FIG. 28 is a front view of the group of the sound producing members taken along a line XXVIII—XXVIII in FIG. 26.

FIGS. 26, 27, and 28 indicate further modification of the trumpet, wherein the constructions of the air passageway change-over valves of the scale operation keys K1 to K3 and the air passageway thereof, and the connections of the connection tube for each cylinder of the scale operation keys, and so on are exactly same as those of the afore-described two embodiments.

In this further modification of the trumpet, a scale change-over member 170 having air passageways 170*a* through 170*h* which communicate with the perforated holes 117*a* through 117*h* of the scale operation key K3 is fixedly provided on the cylinder 117 of the key K3. Each of the air passages 170*a* through 170*h* of the scale change-over member 170 is provided with five outlet ports 171 to 175 (175*a* through 175*h*), respectively, and a group of sound producing members 100' to 104' corresponding to each of the musical scales 100 to 104 are fitted in five vertical rows within the concaved portions opposite to the perforated holes. Further, outside of each of the sound producing members 100' to 104', there are fitted valve plates 176 to 180 for opening and closing the perforated holes 171 to 175 in a manner rotatable by the shafts 181 to 184, respectively. The abovementioned opening and closing valves 176 and 177 use a single shaft 181 in common. The opening and closing valve plate 176 of the abovementioned perforated hole 171 functions to constantly open the perforated hole 171 by a spring 185, while the other opening and closing valve plates 177 to 180 function to close each of the perforated holes 172 to 175 by means of the respective springs 186 to 189. The four opening and closing valve plates 177 to 180 are respectively provided with levers 190 to 193 for each of them. The bent portions $\mathbf{190}_1$ to $\mathbf{193}_1$ of each lever are in contact with the opening and closing valve plate 176 of the perforated hole 171 so as to control its closing action together with a stopper of the valve plate 176.

In the above-described construction, the air passageway is changed-over for playing the instrument by the finger actions of the scale operation keys K1 to K3 without operation of the levers 190 to 193, whereby the air passageway to the sound producing members 100' for the scale 100 can be formed, as the result of which each of the sound producing members 100*a* through 100*h* produces desired tone. Also, when the bottommost lever 193 is pulled against force of the spring 189 to open the perforated hole 175, the opening and closing valve plate 176 of the perforated hole 171 is simultaneously pushed by the bent portion $\mathbf{193}_1$ of the lever 193 to close the perforated hole 171 which has so far been in an opened state, whereby the air passageway is changed-over to the sound producing members 104' for the scale 104. In the same manner, when the other change-over levers are operated, the opening and closing valve plate 176 of the perforated hole 171 can be closed.

As has been described in the foregoing, since the wind instrument according to the present invention can also be played in exactly the same manner as the fingering action of the keys for the trumpet, it is suitable for attaining the skill in the trumpet playing. Moreover, changing the pitch in the tone is not done by the manipulation of the lips which requires high degree of skill, but can be easily realized by the mechanical scale change-over means with the consequence that less work is imposed on the muscle of the mouth, and the instrument can be played even by children of minor ages.

In the foregoing description of the present invention, the saxophone and trumpet have been referred to as the examples, but these instruments are merely illustrative of the invention and not so restrictive to these alone, but the other wind instruments of the side port and valve control types may equally be played on the same principle of the present invention. It should also be understood that any change and modification may be made to the actual construction of the wind instrument according to the present invention within the scope of the present invention as recited in the appended claims.

What is claimed is:

1. In a scale change-over mechanism for a wind instrument having air passage tubing with a mouthpiece at one end thereof; first, second, and third playing keys, each having a piston type air passageway change-over valve fitted within a first, second and third cylinder respectively; at least one frame member to hold said component parts thereon; a first air passageway forming tube to connect said first cylinder to said mouthpiece; second and third air passageway forming tubes to connect between said first and second cylinders, and between said second and third cylinders, respectively; and sound producing reed members, the improvement comprising:

a. a scale change-over member having a plurality of air passageways which have a stratified formation, each one side thereof communicating with a corresponding perforated hole of said third cylinder, and each other side thereof being divided into a plurality of radially extending outlets in a horizontal plane, said scale change-over member being fixed to said third cylinder;

b. a plurality of groups of reeds, each producing sounds in accordance with one musical scale, and being provided at said each outlet in a vertical row;

c. a plurality of scale change-over valve plates for opening and closing each one of vertical rows of said outlets, said valve plates being provided on said scale change-over member; and d. a plurality of scale change-over levers provided on said change-over valve plates for each of them 2. The wind instrument as claimed in claim 1, wherein at least one scale change-over valve plate is a normal open type and the remaining plates are normal closed types.

3. The wind instrument as claimed in claim 2, wherein said normal open type change-over valve plate is closed by each one of said scale change-over levers at the time of the scale change-over operation.

* * * * *